US011401011B2

(12) United States Patent
Johns

(10) Patent No.: US 11,401,011 B2
(45) Date of Patent: Aug. 2, 2022

(54) RETRACTABLE ENTRY AND EXIT SYSTEM FOR BOATS

(71) Applicant: The New Sealift, LLC, Grand Rapids, MI (US)

(72) Inventor: Stephen G. Johns, Merritt Island, FL (US)

(73) Assignee: The New Sealift, LLC, Grand Rapids, MI (US)

( * ) Notice: Subject to any disclaimer, the term of this patent is extended or adjusted under 35 U.S.C. 154(b) by 75 days.

(21) Appl. No.: 17/095,841

(22) Filed: Nov. 12, 2020

(65) Prior Publication Data

US 2021/0147039 A1 May 20, 2021

Related U.S. Application Data

(60) Provisional application No. 62/935,360, filed on Nov. 14, 2019.

(51) Int. Cl.
*B63B 27/14* (2006.01)

(52) U.S. Cl.
CPC ..... *B63B 27/14* (2013.01)

(58) Field of Classification Search
CPC . B63B 27/14; B63B 2029/022; B63B 27/146; B60R 3/02
See application file for complete search history.

(56) References Cited

U.S. PATENT DOCUMENTS 4,848,821 A * 7/1989 Llewellyn ..... E06C 5/02 280/166
7,707,955 B1 * 5/2010 Johns, Jr. ..... B63B 27/36 114/259
8,375,880 B1 * 2/2013 St. Clair, Jr. ..... B63B 29/00 182/84
9,205,896 B2 * 12/2015 Mueller ..... B63B 27/14
9,586,655 B1 3/2017 Butler

* cited by examiner

*Primary Examiner* — Anthony D Wiest
(74) *Attorney, Agent, or Firm* — Warner Norcross + Judd LLP

(57) ABSTRACT

A retractable entry/exit system for a boat that mounts below a swim platform or other similar boat structure. The system has a main frame, a linkage, a number of step assemblies and a single actuator. The actuator is configured to move the linkage to selectively extend or retract the step assemblies. When retracted, the system is folded into a compact arrangement under the mounting structure. When extended, the step assemblies extend beyond the mounting structure, where they can be used to conveniently enter and exit the boat or as a place to rest, lounge, sit or otherwise enjoy the water. The linkage may include a bell crank assembly with integral linkage arms, as well as a pair of supplemental linkage arms. The linkage arms may be disposed toward opposite sides of the system and may be operatively coupled to step brackets that support opposite ends of each step assembly.

9 Claims, 12 Drawing Sheets

RETRACTABLE ENTRY AND EXIT SYSTEM FOR BOATS

BACKGROUND OF THE INVENTION

The present invention relates to boats and more particularly to a retractable entry and exit system for a boat.

Entering and exiting a boat can present challenges. To assist, ladders are often used by recreational boat users to enter and exit a boat. Some boats include integral ladders, while others are fitted with separate ladders that can be removed and stored when not in use. A range of boat ladders are available in the boating market. Although ladders provide some level of assistance, they have a number of characteristics that can make them difficult to use, particularly for the elderly and the physically challenged. For example, the ladder rungs are generally in a near vertically arrangement which makes use awkward. Further, removable ladders are often hung somewhat loosely in place and therefore have a tendency to wobble and move during use.

In an effort to provide an improved system, at least one conventional swim platform available in the market includes a fold down step that can be used to enter and exit the boat via the swim platform. Although the fold down step may be easier to use than a conventional ladder, it has a number of drawbacks. For example, it takes up space on the swim platform and leaves the swim platform with an irregular surface upper surface when the step is folded down for use. To reduce these issues, it is desirable to keep the size of the step to a minimum. However, reducing the size of the step can make it more difficult to use and reduce its effectiveness. Further, it can be difficult to climb up onto or step down from the step depending on the height of the swim platform above the water and the depth of the water. To illustrate, it may be difficult to step down from the boat onto the beach or to step from the beach back onto the boat if the swim platform depending on the height of the step relative to the beach.

Many boat owners enjoy to take their pets boating with them on the boat. As with humans, it can be difficult for many pets to enter and exit a boat. However, ladders and existing fold-down steps can be particularly difficult for pets to use. With regard to ladders, pets typically have a hard time climbing ladder rungs not only because they are arranged vertically, but also because they are relatively narrow. A fold down step can be easier for a pet to climb, but it can still be difficult for the pet to use the step depending on the position of the step relative to the swim platform, the water level and the elevation of any beach. Further, fold down steps are relatively small and are therefore more difficult for larger pets to use.

There remains a need for an improved entry and exit system for a boat.

SUMMARY OF THE INVENTION

The present invention provides a retractable entry and exit system for a boat. The system is configured to mount below a swim platform, access platform, pontoon boat deck or other similar boat structures, and has a single central actuator assembly configured to operate a pair of spaced-apart linkages to selectively extend and retract one or more steps carried by the linkage. In the retracted position, the steps and associated linkage are folded into a compact arrangement under the swim platform (or other mounting structure), where they occupy limited space and are generally hidden from view. In the extended position, the steps and associated linkage are extended beyond the swim platform (or other mounting structure), where they can be used to conveniently enter and exit the boat or as place to rest, lounge, sit or otherwise enjoy the water. The system is well suited for use not only with humans, but also with pets, which can have a particularly difficult time entering.

In one embodiment, the system includes a main frame, a linkage movable coupled to the main frame, a plurality of step assemblies carried by the linkage and an actuator assembly for moving the linkage (and consequently the steps) relative to the main frame. In one embodiment, the frame is mounted to the undersurface of a suitable mounting structure, such as the swim platform or pontoon boat deck.

In one embodiment, the actuator assembly is a linear actuator that is mounted between the frame and the linkage. In operation, extension and retraction of the linear actuator moves the system between the retracted position and the extended position. In alternative embodiments, the actuator assembly may be a rotary actuator rather than a linear actuator.

In one embodiment, the actuator assembly includes a self-contained hydraulic linear actuator that extends and retracts to move the steps between the retracted position and the extended position. The self-contained hydraulic actuator includes an integrated hydraulic pump, hydraulic reservoir and hydraulic cylinder. In one embodiment, the hydraulic actuator is controlled by a single pair of wires that supply DC power. Supplying power with one polarity causes the hydraulic actuator to extend and supply power the opposite polarity causes the hydraulic actuator to retract. In such embodiments, the self-contained hydraulic actuator facilitates installation on a boat as it requires only a single pair of wires to be routed to the actuator. In one embodiment, the wires may be fitted, for example, through a watertight bulkhead fitting in the transom of the boat beneath the swim platform.

In one embodiment, the linkage includes a bell crank assembly having a longitudinally-extending torque tube, a centrally-located bell crank and integral linkage arms located toward opposite ends of the torque tube. The actuator is operatively coupled to the bell crank so that extension and retraction of the actuator causes rotation of the bell crank assembly relative to the main frame, which in turn causes corresponding movement of the integral linkage arms.

In one embodiment, the linkage includes first and second pairs of linkage arms disposed toward opposite sides of the main frame. In one embodiment, each pair of linkage arms includes an integral linkage arm and a supplemental linkage arm. The upper end of each integral linkage arm is affixed to the torque tube making the integral linkage arms essentially integral parts of the bell crank assembly. In operation, movement of the bell crank result in rotation of the torque tube and consequently in movement of the integral linkage arms disposed toward opposite ends of the torque tube. In one embodiment, a cross support may extend between the integral linkage arms to provide structure support.

In one embodiment, the upper end of each supplemental linkage arm is pivotally connected to the main frame in spaced relation to the integral linkage arm.

In one embodiment, the linkage is arranged so that the self-contained hydraulic actuator remains at an angle of at least 15° from horizontal throughout its entire range of motion. This may help to facilitate proper operation of select hydraulic actuators that may have operational issues when oriented in a generally horizontal orientation. In alternative embodiments, the hydraulic actuator may include an internal bladder that allows proper operation even when the self-contained hydraulic actuator is oriented in a generally horizontal position. In such embodiments, the linkage may be arranged to allow the hydraulic actuator to move into a generally horizontal position. In some implementations, this may facilitate an even more compact retracted system.

In one embodiment, the system includes a plurality of steps disposed in spaced relationship along the linkage arms. In one embodiment, the system includes an upper step and a lower step where the lower step is substantially deeper that the upper step. The lower step may have a depth of about 2.5 times the depth of the upper step, or more generally in the range of 1.5 to 4 times. In one embodiment, the upper step has a depth of about 6.5 inches and the lower step has a depth of about 16 inches. In alternative embodiments, the system may include three or more steps. The rise of each step (when in the extended position) is set to facilitate comfortable use and may, for example, be 9.5 inches or more generally in the range of 6-10 inches. In one embodiment, the depths of the upper and lower steps are selected so that the aft edges of the steps are generally aligned when in the retracted position.

In one embodiment, the linkage that maintains the steps in a generally horizontal orientation throughout the entire range of motion. In one embodiment, each step is integrated into a step assembly that includes a pair of step brackets that are coupled to the linkage on opposite sides of the system. In use, the step brackets support opposite ends of each step. In one embodiment, the step brackets are joined by a framework configured to join the step brackets and provide structural support under the step.

In one embodiment, the linkage arms and the step brackets are coupled together so that the steps remain in a generally horizontally orientation throughout the entire range of motion of the linkage.

In one embodiment, the linkage is configured so that the integral linkage arms and the supplemental linkage arms are disposed on opposite sides of the associated step brackets, thereby allowing the integral linkage arms and the supplemental linkage arms to pivot compactly along opposite sides of the corresponding step brackets as the system is moved into the retracted position. In one embodiment, the integral linkage arms are disposed on the inside of the step brackets and the supplemental linkage arms are located on the outside.

In one embodiment, the upper step defines a recess configured to accommodate a portion of the actuator assembly when the steps are retracted. The recess fits around a portion of the actuator assembly to allow the upper step to have an overall depth that is greater than would otherwise be permitted by the physical constraints of the actuator assembly.

In one embodiment, the lower step includes an outer portion and an inner portion. The inner portion is narrowed to allow it to fit within the linkage when the steps are retracted.

In one embodiment, the main frame includes a pair of side members. Each side member is arranged in a common plane with the corresponding step bracket of the upper step. In one embodiment, the side members and the corresponding step brackets are configured to closely nest when the system is folded into the retracted position.

In one embodiment, the step brackets of the upper step assembly and the lower step assembly are arranged in a common plane, and are configured to closely nest when the system is moved into the retracted position. In one embodiment, the step brackets are generally L-shaped having a main portion that is coupled to the linkage arms and a reduced-height step portion that underlies and supports the associated step. The two L-shaped step brackets may nest closely when the system is fully retracted.

In one embodiment, the system includes a locking system for securing the steps in the retracted position. For example, in one embodiment, the supplemental linkage arms may each include an ear that overlaps with the frame when the system is fully retracted. The ear and the frame may define a pair of holes that align when fully retracted. Locking pins may be fitted through the aligned holes to secure the system in the fully retracted position. This may be particularly helpful if the actuator assembly fails and is unable to retain the system in the retracted position.

The present invention provides a simple and effective retractable step system. The unique structure of the frame, linkage and step assemblies allows the use of a single central actuator, thereby reducing complexity and cost without sacrificing stability. The use of a self-contained actuator facilitates installation as only a single pair of wires need to be routed to the system. This eliminates the need to run a number of hydraulic lines through the transom as is required with conventional hydraulic systems. The unique configuration of the step brackets and associated linkage arms allows the system to collapse into an extremely small package, thereby reducing the potential for the system to interfere. By providing a linkage that maintains the steps in a generally horizontal orientation throughout the range of motion, the steps can be stopped and used in intermediate positions. For example, when at a beach or in shallow water, where the steps cannot be fully extended, they can be extended until they reach the desired position, for example, just above the beach or just above the underlying ground. The lower step is deep enough to function as a landing, which expands the possible uses of the system for both humans and pets. The depths of the upper and lower steps are sized so that the lower step has maximum depth without increasing the profile of the system in the retracted position.

These and other features of the invention will be more fully understood and appreciated by reference to the description of the embodiments and the drawings.

Figure 1:
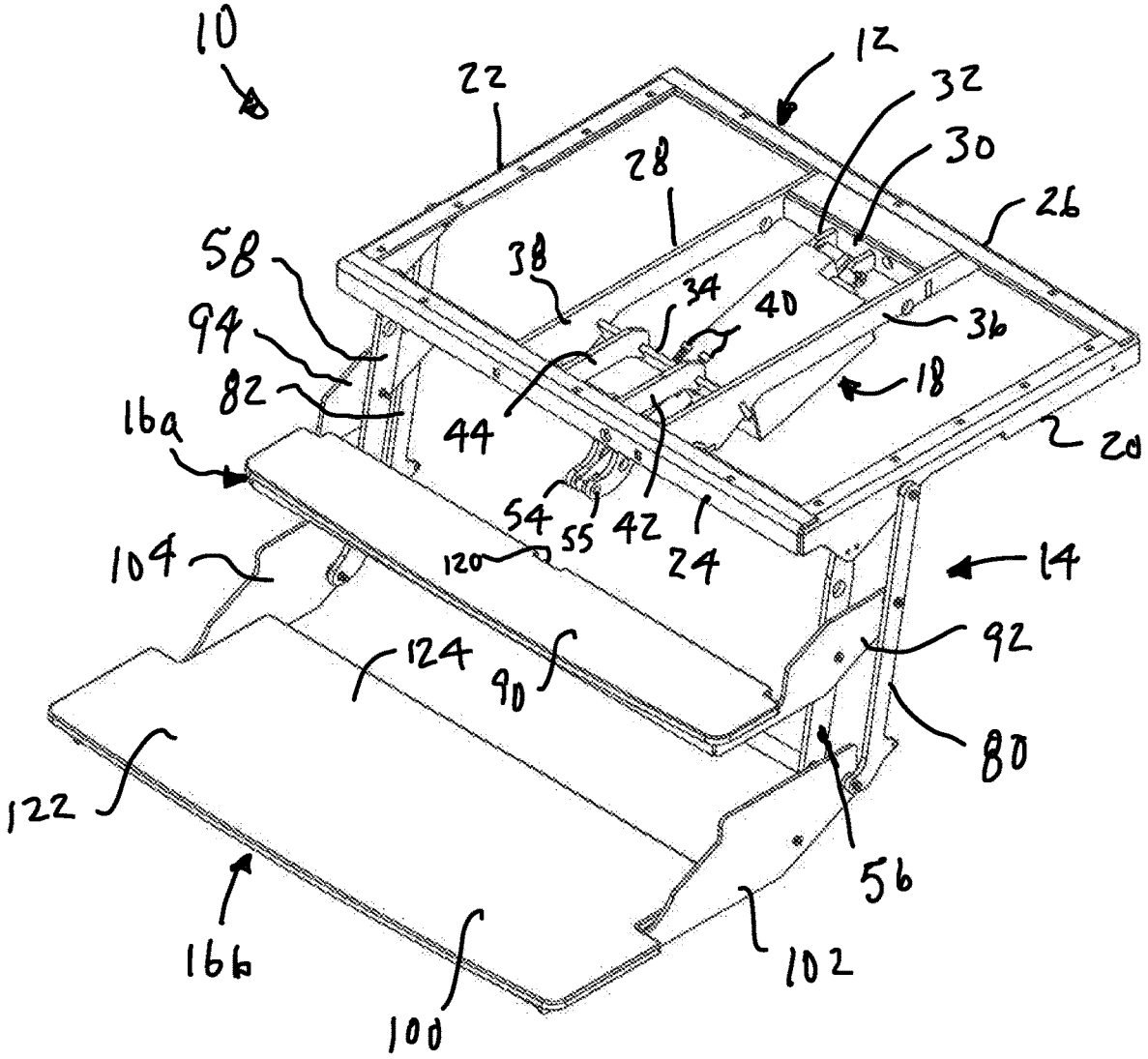
FIG. 1 is a top perspective view of a retractable step system in accordance with an embodiment of the present invention shown with the steps extended.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF CURRENT EMBODIMENTS

Figure 2:
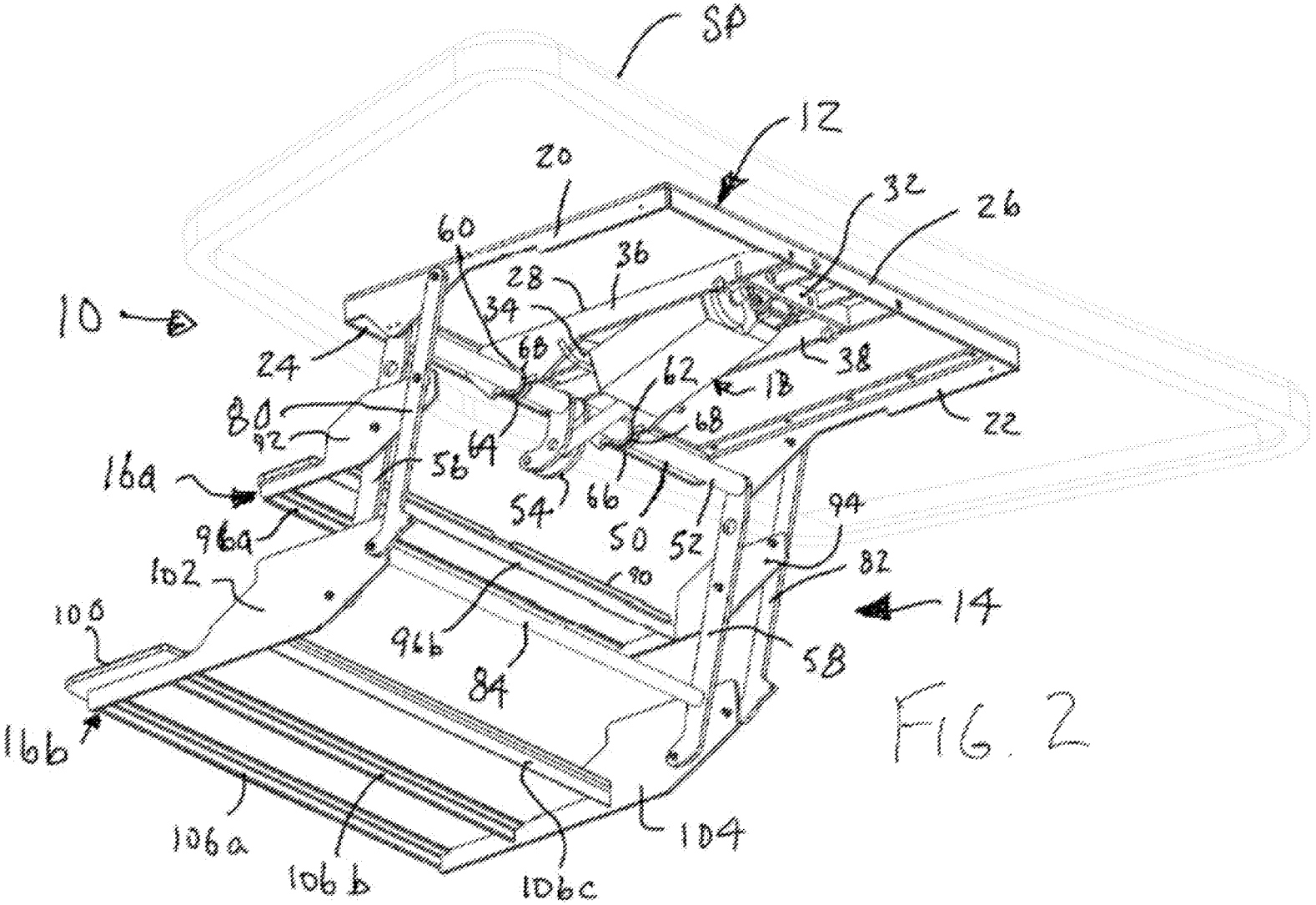
FIG. 2 is a bottom perspective view of a retractable step system in accordance with an embodiment of the present invention shown mounted below a swim platform with the steps extended.

A retractable step system for a boat in accordance with an embodiment of the present invention is shown in FIGS. 1 and 2. The step system 10 is configured to mount below a swim platform SP, access platform, pontoon boat deck or other similar boat structures, and is selectively movable between a retracted position in which the steps are hidden below the mounting structure and an extended position in which the steps are extended from beneath the structure for use (e.g. to enter or exit the boat or for lounging). In the illustrated embodiment, the system includes a main frame 12, a linkage 14 movable coupled to the main frame 12, a plurality of step assemblies 16*a-b* carried by the linkage 14 and an actuator assembly 18 for moving the linkage 14 (and consequently the steps) relative to the main frame 12. FIGS. 2 and 4 show the main frame 12 mounted to the undersurface of a swim platform SP, but the system 10 may be mounted to other suitable mounting structure, such as the undersurface of the deck of a pontoon boat. In the illustrated embodiment, the actuator assembly 18 is automated and can be controlled by a user from within the boat. For example, the system 10 may have an onboard control (not shown) that can be used to selectively extend the steps when they are needed (See FIG. 1) and retract them when they are not (See FIG. 3). The system 10 may also have a control that is accessible from the water.

For purposes of disclosure the present invention is described in the context of a retractable step system 10 mounted beneath a swim platform SP located at the aft end of a boat. To facilitate disclosure in this context the terms fore (or forward) and aft may be used to denote directions relative to the boat. These terms are not intended to limit the mounting position or orientation of the system 10 with respect to the boat. Instead, it should be understood that the system 10 may be mounted at other locations and at other orientations. For example, a system 10 may be mounted to the undersurface of the fore deck of a pontoon boat, in which case the terms fore (or forward) and aft would be reversed.

The retractable step system 10 will now be described in more detail with reference to FIGS. 1-16. As noted above, the system 10 generally includes a main frame 12, a linkage 14 movable coupled to the main frame 12, a plurality of step assemblies 16*a-b* carried by the linkage 14 and an actuator assembly 18 for moving the linkage 14 (and consequently the steps) relative to the main frame 12. In the illustrated embodiment the main frame 12 is a generally rectangular structural framework configured to mount to a generally planar undersurface. It may, however, be configured to mount to non-planar surfaces, if desired. As perhaps best shown in FIGS. 1, 2, 6 and 14, the main frame 12 is a peripheral structure having a pair of side members 20 and 22 that are joined by an outer frame member 24 and an inner frame member 26. The main frame 12 of the illustrated embodiment includes a subframe 28 configured to support the actuator assembly 18 and the bell crank assembly 50 (described below). In this embodiment, the subframe 28 is mounted between and supported by the outer frame member 24 and the inner frame member 26. The subframe 28 of this embodiment is generally rectangular with side plates 36 and 38, as well as a cross member 30 that receives the inner end of the actuator assembly 18. For example, the illustrated cross member 30 includes a clevis 32 configured to receive one end of the actuator assembly 18. The subframe 28 also includes one or more cross supports, such as cross support 34, that provide reinforcement to the subframe 28. In this embodiment, cross support 34 receives stop bolts 40. The stop bolts 40 are positioned in the path of the bell crank 54, and may be extended or retracted with respect to the cross support 34 to set the rearward limit on travel of the bell crank 54 and consequently the linkage 14 and the steps. In the illustrated embodiment, the subframe 28 also includes a pair of intermediate supports 42 and 44 that extend between the cross support 34 and the outer frame member 24. In this embodiment, the intermediate support 42 and 44 are somewhat forked-shaped fitting over the cross support 34.

The illustrated main frame 12, including subframe 28, is merely exemplary. The design and configuration of the main frame 12, including subframe 28, may vary from application to application as desired. For example, the size, shape and configuration of the main frame 12, including the subframe 28, may vary.

Figure 11:
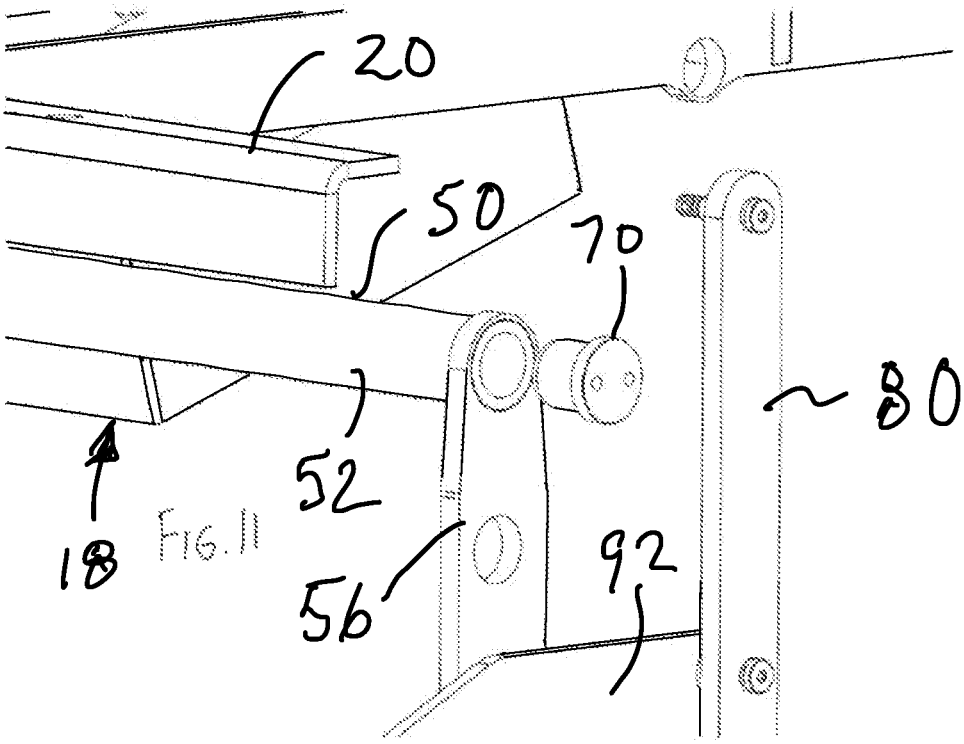
FIG. 11 is a partially exploded perspective view of a portion of the system showing the torque tube and the bushing.
Figure 12:
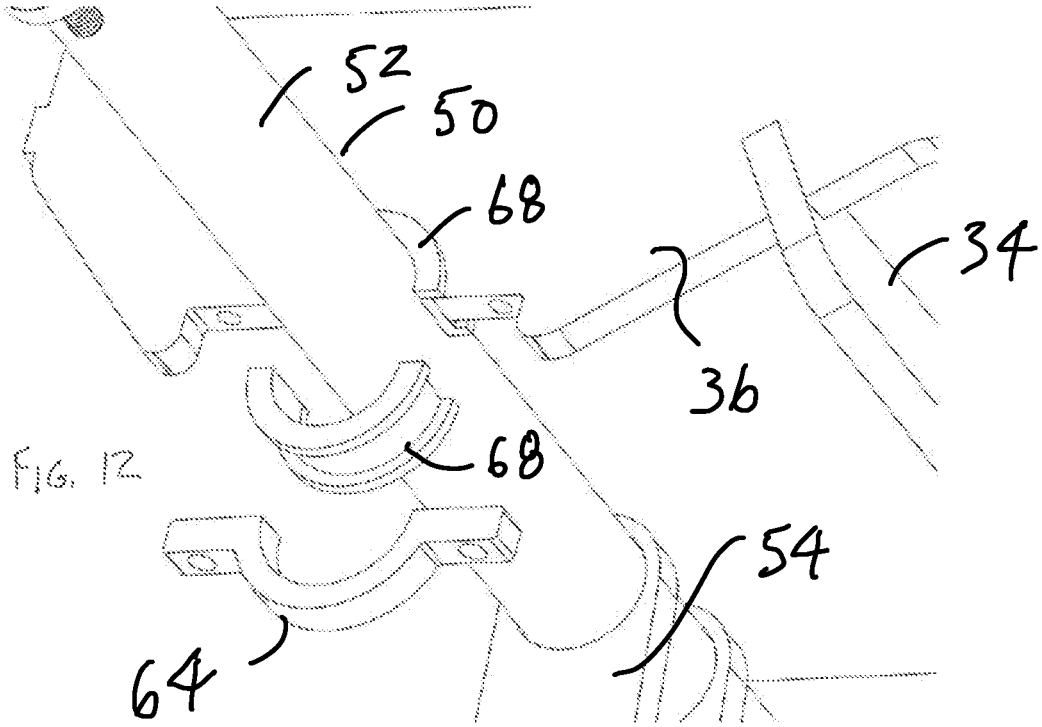
FIG. 12 is a partially exploded perspective view of a portion of the system showing the subframe, the torque tube and a torque tube bracket.
Figure 15:
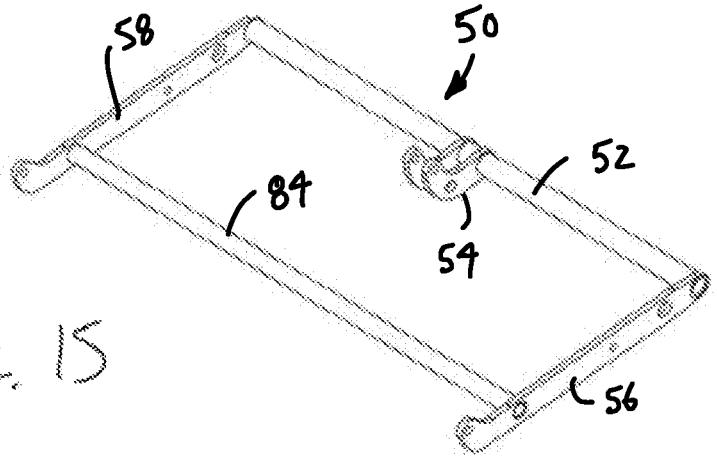
FIG. 15 is a perspective view of the bell crank assembly.
Figure 16:
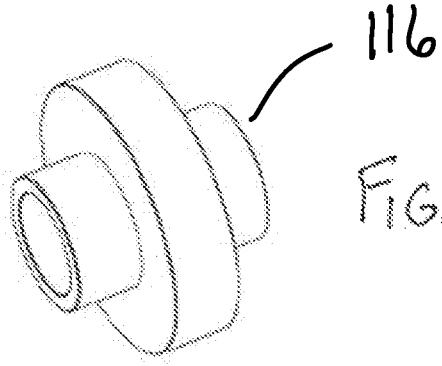
FIG. 16 is a perspective view of a T-bushing.

In the illustrated embodiment, the linkage 14 includes a bell crank assembly 50 having a longitudinally-extending torque tube 52, a centrally-located bell crank 54 and integrated linkage arms 56 and 58 located toward opposite ends of the torque tube 52 (See FIG. 15). In the illustrated embodiment, the torque tube 52 is rotatably mounted to the undersurface of the subframe 28 extending between the side members 20 and 22 of the main frame 12. As perhaps best shown in FIGS. 2 and 12, the side plates 36 and 38 each define a torque tube seat 60 and 62. The torque tube 52 is rotatably secured in the seats 60 and 62 by brackets 64 and 66, which may be secured, for example, by fasteners that extend through the brackets 64 and 66 into the side plates 36 and 38. Bushings 68 (or bearings) may be disposed about the torque tube 52 to facilitate rotation. In the illustrated embodiment, each bushing 68 includes two generally C-shaped Delrin bushings (or similar urethane bushings) that close about the torque tube 52 from opposite sides (See FIGS. 9, 10 and 12). The Delrin bushings may be replaced by other types of bushings or bearings, such as sintered bronze bushings or various bearing assemblies. Opposite ends of the torque tube 52 are fitted over end bushings 70 and 72, which are secured to the side members 20 and 22. The bushings 70 and 72 rotatably support opposite ends of the torque tube 52. For example, FIG. 11 is an exploded view showing bushing 70 removed from one end of the torque tube 52. In the embodiment, the opposite end of the torque tube 52 is essentially identical. In this embodiment, the end bushings 70 and 72 are secured to the side members 20 and 22 by fasteners. For example, fasteners (not shown) may extend through the side members 20 and 22 into screw holes in the outer surfaces of the end bushings 70 and 72. In the illustrated embodiment, the end bushings 70 and 72 are Delrin bushings or similar urethane bushings, but the torque tube may be supported at opposite ends by other types of bushings or bearings.

In the illustrated embodiment, the bell crank 54 is in the form of a clevis that is affixed to the torque tube 52, for example, by welding. The bell crank 54 pivotally receives the outer end of the actuator assembly 18. A clevis pin 55, bolt or other similar structure may extend through the bell crank 54 and the free end of the actuator assembly 18 to operatively secure the actuator to the bell crank 54. As perhaps best shown in FIG. 7, the bell crank 54 of the illustrated embodiment has a bend toward the middle to accommodate the upper step 90 and provide a lower profile when the system 10 is retracted. The size, shape and configuration of the bell crank 54 may vary from application to application as desired.

Referring now to FIGS. 2 and 15, the integral linkage arms 56 and 58 are affixed to the torque tube 52 near opposite ends. For example, the integral linkage arms 56 and 58 may be welded or otherwise secured to the torque tube. In the illustrate embodiment, the integral linkage arms 56 and 58 are configured to receive and support the step assemblies 16*a-b* in spaced relationship. A cross support 84 may extend between the remote ends of the integral linkage arms 56 and 58 to provide additional structural support. As shown in FIG. 15, the remote ends of the linkage arms 56 and 58 may include a bend configured to accommodate the steps 16*a-b* when the system 10 is fully retracted.

In the illustrated embodiment, the linkage 14 further includes first and second supplemental linkage arms 80 and 82. As perhaps best shown in FIGS. 1-4, the supplemental linkage arms 80 and 82 are pivotally mounted to the side members 20 and 22 in spaced relation to the integral linkage arms 56 and 58. In the illustrated embodiment, the remote end of each supplemental linkage arms 80 and 82 includes a bend. In the illustrated embodiment, the supplemental linkage arms 80 and 82 cooperate with the integral linkage arms 56 and 58 to receive and support the step assemblies 16*a-b*.

In the illustrated embodiment, the integral linkage arms 56 and 58 and the supplemental linkage arms 80 and 82 are of sufficient length to support two step assemblies 16*a-b* (See FIG. 1). In alternative embodiments, the length of the linkage arms 56, 58, 80 and 82 may be varied to accommodate a different number of step assemblies 16*a-b*. For example, the linkage arms 56, 58, 80 and 82 may be extended to support one or more additional step assemblies as desired to increase the reach of the extended system 10.

Figure 13:
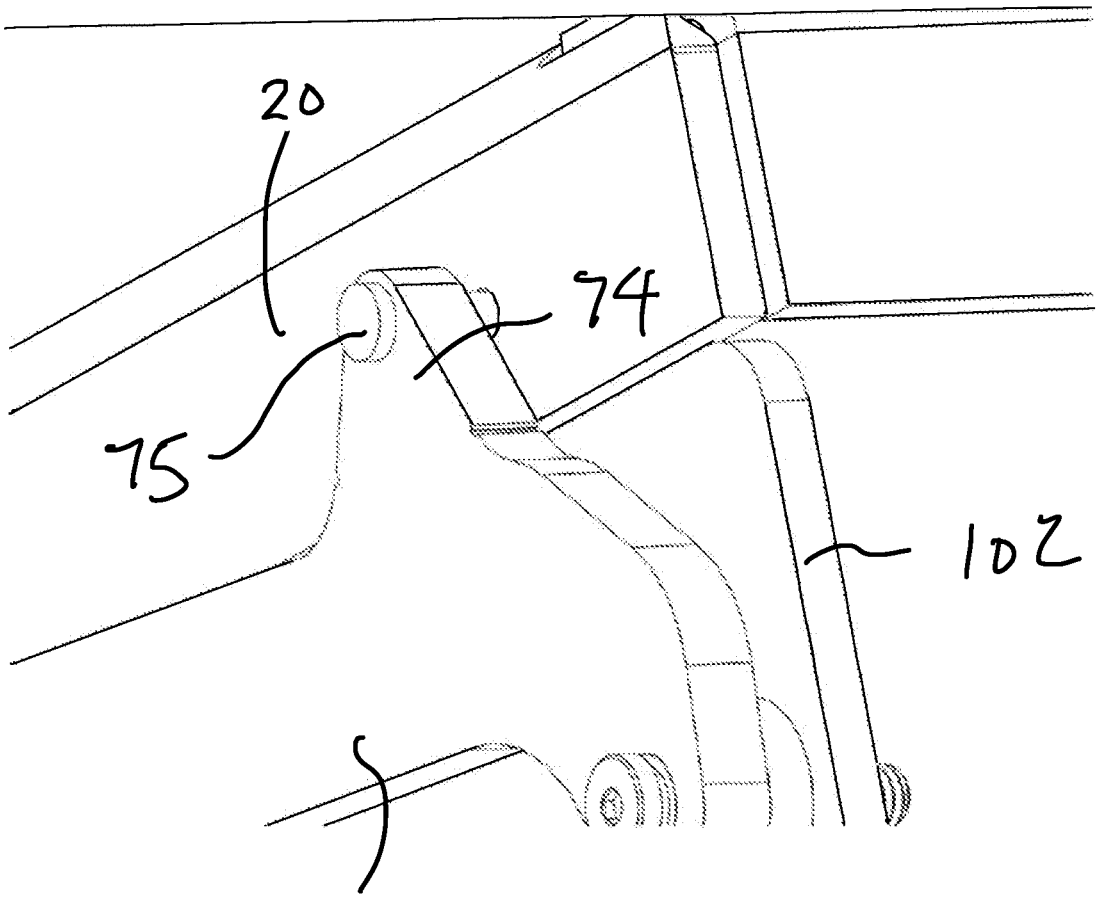
FIG. 13 is a perspective view of a portion of the retractable step system showing the locking system.
Figure 14:
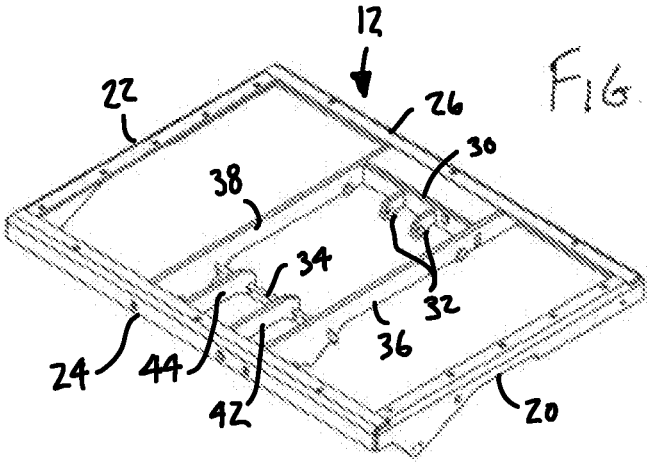
FIG. 14 is a perspective view of the main frame.

The system 10 of the illustrated embodiment includes a locking arrangement for securing the system 10 in the retracted position. FIG. 13 is an enlarged view of the illustrated locking arrangement on one side of the main frame 12 in the locked condition. The locking arrangement may be essentially identical on the opposite side. In this embodiment, the remote end of each supplemental linkage arm 80 and 82 includes a locking ear 74 that overlaps with the main frame 12 when the system 10 is fully retracted. The ears 74 and the side members 20 and 22 may define a pair of holes that align when the system 10 is fully retracted. A locking pin 75 may be fitted through the aligned holes on opposite sides to secure the system 10 in the fully retracted position. This may be particularly helpful if the actuator assembly 18 fails and is unable to retain the system 10 in the retracted position.

In the illustrated embodiment, the system 10 includes two step assemblies—upper step assembly 16*a* and lower step assembly 16*b*. The upper step assembly 16*a* generally includes an upper step 90, a pair of step brackets 92 and 94 and a step framework 96. The step brackets 92 and 94 are disposed on opposite sides of the system 10, and are configured to support opposite ends of the upper step 90. More specifically, on one side of the system 10, step bracket 92 is pivotally connected to integral linkage arm 56 and supplemental linkage arm 80 and, on the opposite side, step bracket 94 is pivotally connected to integral linkage arm 58 and supplemental linkage arm 82. The step framework 96 is configured to join the step brackets 92 and 94, and to provide structural support for the upper step 90. In the illustrated embodiment, the step framework 96 for the upper step 90 includes two cross members 96*a-b*. The lower step assembly 16*b* is similar to upper step assembly 16*a*, and generally includes a lower step 100, a pair of step brackets 102 and 104 and a step framework 106. As with the upper step assembly 16*a*, the step brackets 102 and 104 of the lower step assembly 16*b* are disposed on opposite sides of the system 10, and are configured to support opposite ends of the lower step 100. As can be seen, step bracket 102 is pivotally connected to integral linkage arm 56 and supplemental linkage arm 80 and step bracket 104 is pivotally connected to integral linkage arm 58 and supplemental linkage arm 82. The step framework 106 for the lower step 100 is configured to join the step brackets 102 and 104, and to provide structural support for the lower step 100. In the illustrated embodiment, the step framework 106 for the lower step 100 includes three cross members 106*a-c*. The upper step 90 and the lower step 100 may be manufactured from marine board, plastic composite or other suitable materials.

In the illustrated embodiment, the linkage arms 56, 58, 80 and 82 are rotatably connected to the main frame 12 and the step brackets 92, 94, 102 and 104 by fasteners that are fitted with bushings or bearings. For example, each of these connection points may include a T-bushing 116 that not only facilitates rotation, but also provides spacing between adjacent parts (See FIG. 16). The T-bushing 116 of the illustrated embodiment are Delrin bushings or similar urethane bushings, but they may be replace by bearings or by other bushings. It should be understood that this connection structure is merely exemplary and that it may be replaced by other connections that allow pivotal or rotational movement of the linkage 14.

In the illustrated embodiment, the lower step 100 is substantially deeper that the upper step 90 allowing the lower step 100 to function as a landing. The greater depth of the lower step 100 may facilitate use, particularly by individuals that face physical challenges and by large pets that may not fit well with narrower steps. Even when the steps are not being used as an entry and exit system, the system 10 can be extended and the lower step 100 can be used as a place to sit, rest or lounge in the water. In the illustrated embodiment, the upper step 90 may have a depth of about 6.5 inches, or more generally in the range of 5 to 12 inches, and the lower step 100 may have a depth of 16 inches or more generally in the range 10 to 24 inches. In this embodiment, the lower step has a depth of about 2.5 time the depth of the upper step. These dimensions are exemplary, however, and the size, shape and configuration of the steps may vary from application to application. In the illustrated embodiment, the depths of the upper and lower steps are selected so that the outer edges of the steps are generally in vertical alignment when in the retracted position. This allows the lower step 100 to have greater depth without increasing the profile beyond the upper step 90. In alternative embodiments, the system may include a different number of steps, such as one step, three steps or more steps.

Figure 6:
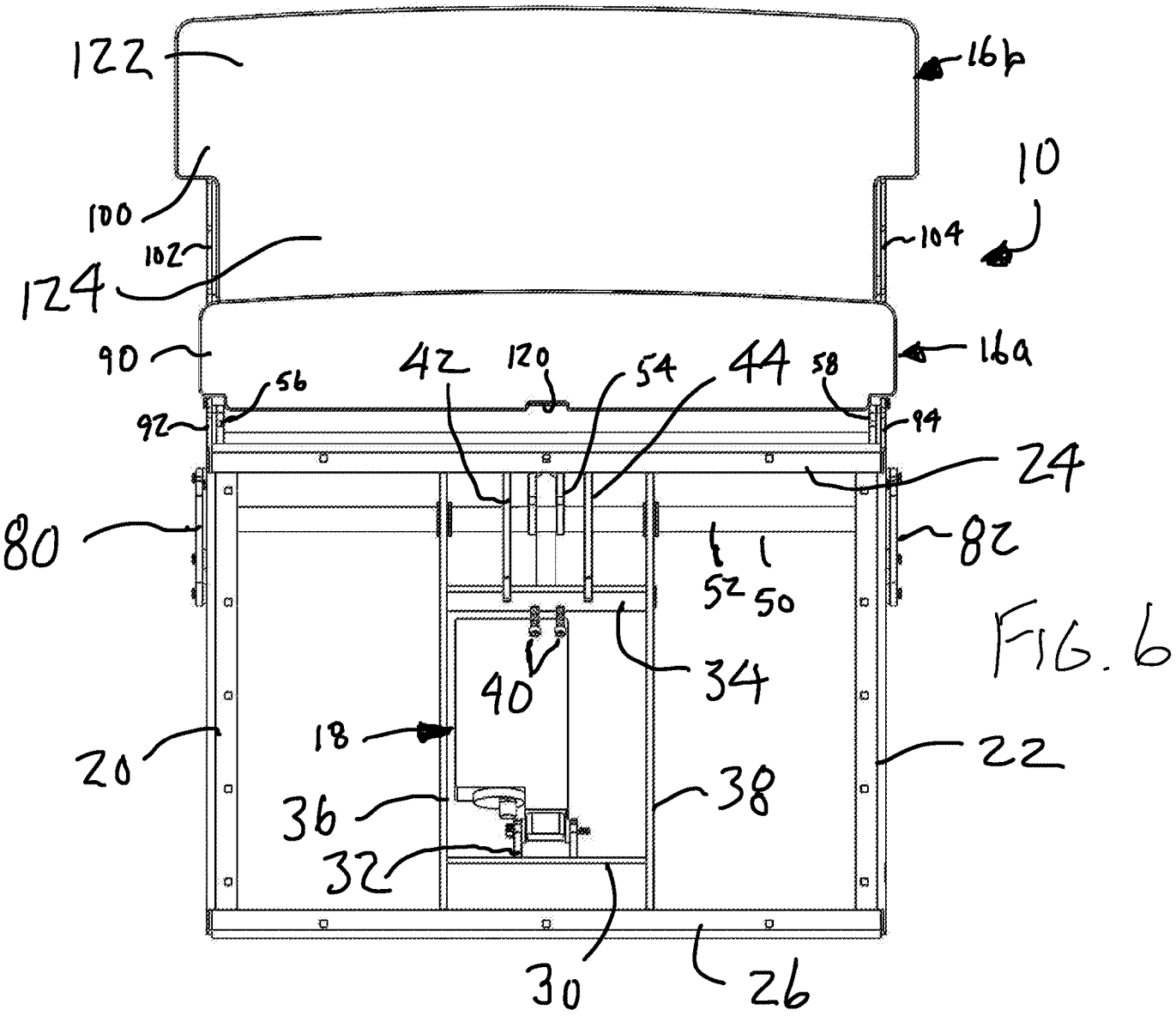
FIG. 6 is a top plan view of the retractable step system.
Figure 7:
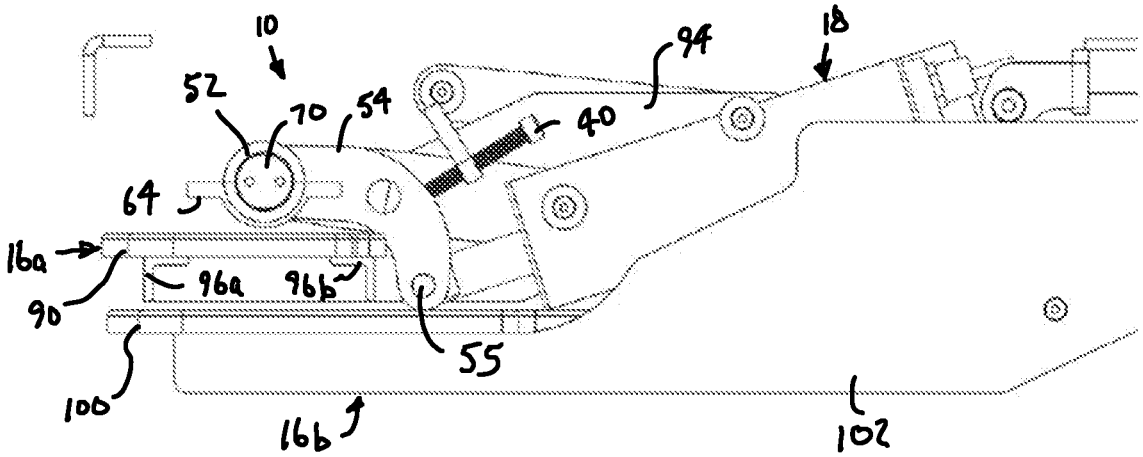
FIG. 7 is a side view of the retractable step system with portions removed to show a stop bolt engaged with the bell crank.
Figure 8:
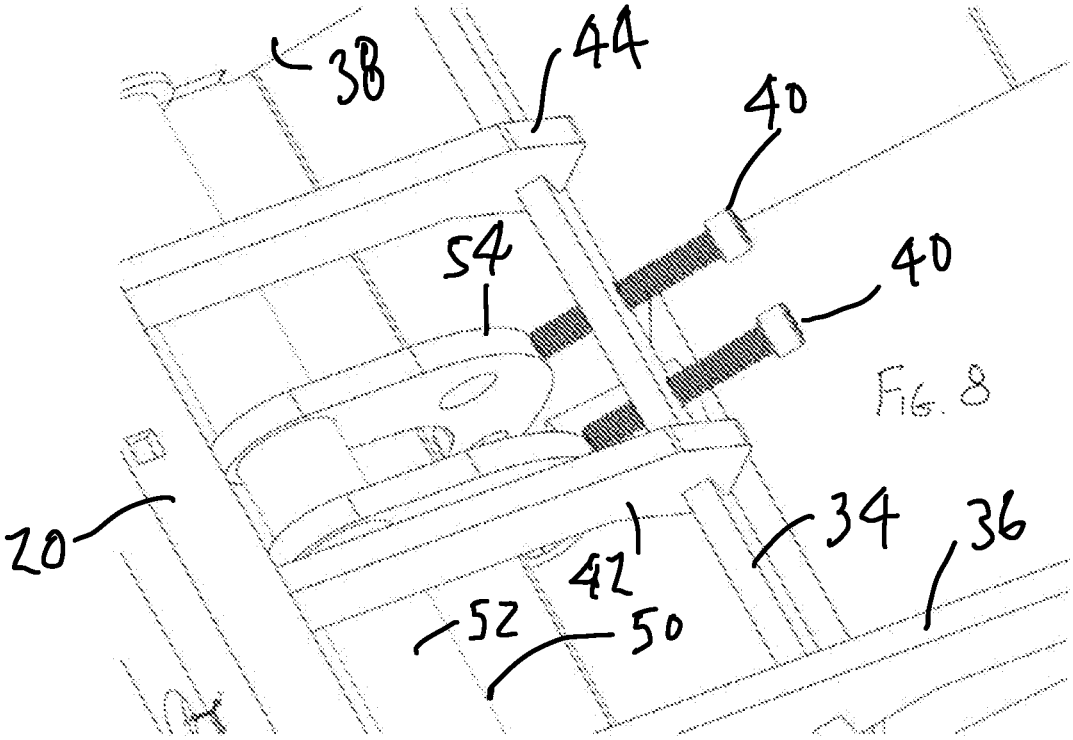
FIG. 8 is a perspective view of a portion of the retractable step system showing the stop bolts engaged with the bell crank.
Figure 9:
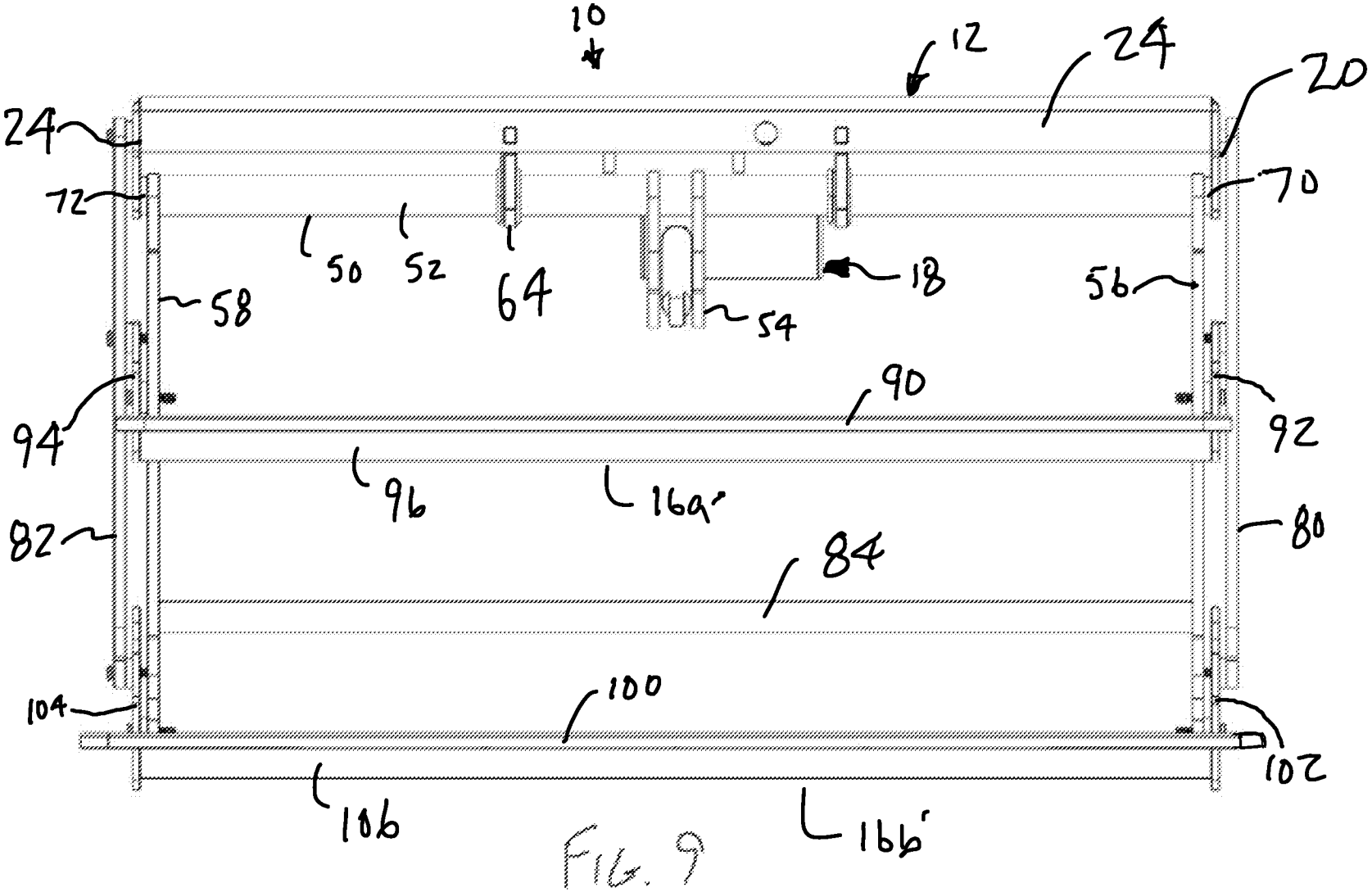
FIG. 9 is a front view of the system in the extended position.
Figure 10:
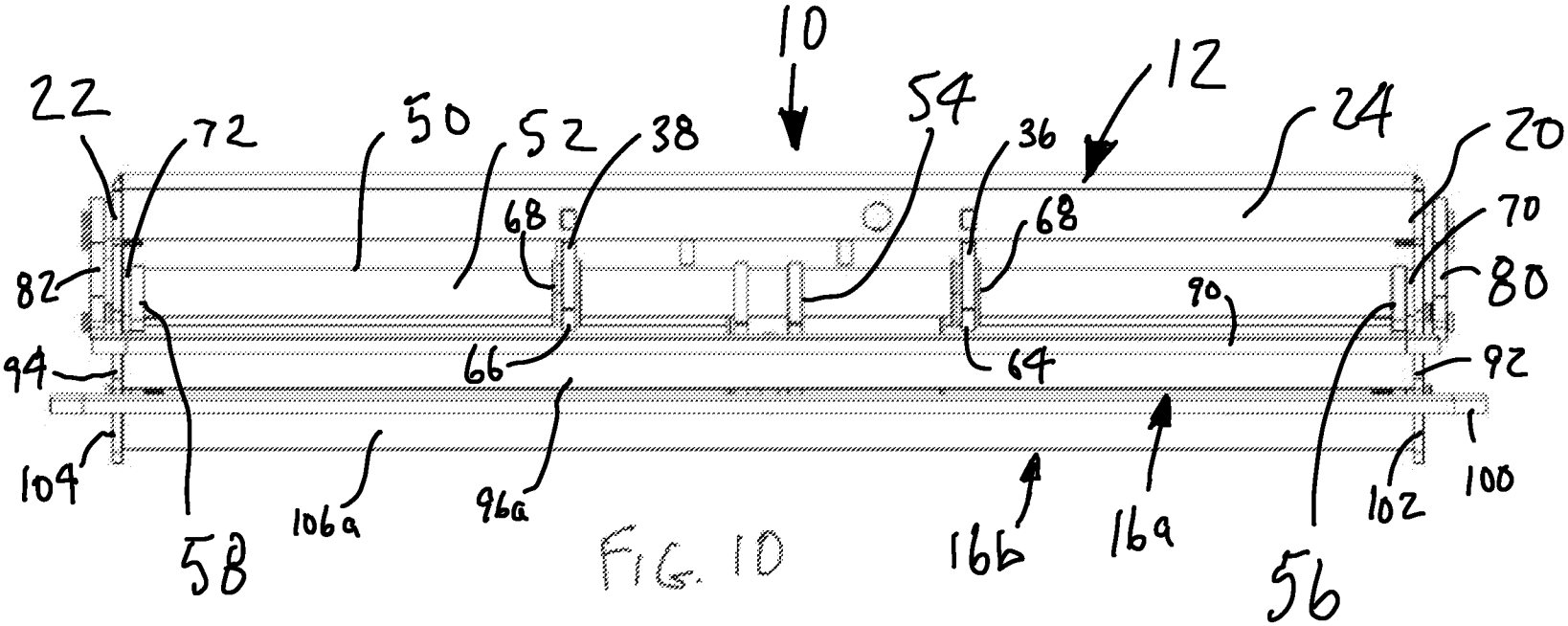
FIG. 10 is a front view of the system in the retracted position.

In the illustrated embodiment, the upper step 90 defines a recess 120 configured to accommodate a portion of the actuator assembly 18 when the steps are retracted (See FIG. 6). The recess 120 fits around a portion of the actuator assembly 18 to allow the upper step 90 to have an overall depth that is greater than would otherwise be permitted by the physical constraints of the actuator assembly 18. Further, in the illustrated embodiment, the lower step 100 includes an outer portion 122 and an inner portion 124. The inner portion 124 is narrowed to allow it to fit within the linkage 14 when the steps 90, 100 are retracted. This allows the lower step 100 to have significantly more depth than the upper step 90.

In the illustrated embodiment, the actuator assembly 18 is operatively coupled between the main frame 12 and the bell crank 54 so that extension and retraction of the actuator assembly 18 causes rotation of the bell crank assembly 50 relative to the main frame 12, which in turn causes corresponding movement of the integrated linkage arms 56 and 58, the supplemental linkage arms 80 and 82 and the step assemblies 16*a-b*. In the illustrated embodiment, the actuator assembly 18 includes a self-contained hydraulic linear actuator that extends and retracts to move the step assemblies 16*a-b* between the retracted position and the extended position. The self-contained hydraulic actuator 18 of the illustrated embodiment includes an integrated hydraulic pump, hydraulic reservoir and hydraulic cylinder. In the illustrated embodiment, the hydraulic actuator 18 is controlled by a single pair of wires that supply DC power. In this embodiment, supplying power with one polarity causes the hydraulic actuator 18 to extend and supplying power in the opposite polarity causes the hydraulic actuator 18 to retract. In such embodiments, the self-contained hydraulic actuator 18 facilitates installation on a boat as it requires only a single pair of wires to be routed to the actuator. The wires may be fitted, for example, through a watertight bulkhead fitting in the transom of the boat beneath the swim platform.

In the illustrated embodiment, the linkage 14 is arranged so that the self-contained hydraulic actuator assembly 18 remains at an angle of at least 15° from horizontal throughout its entire range of motion. This may help to facilitate proper operation of select hydraulic actuators that may have operational issues when oriented in a generally horizontal orientation. In alternative embodiments, the hydraulic actuator assembly 18 may include an internal bladder that allows proper operation even when the self-contained hydraulic actuator is oriented in a generally horizontal position. In such embodiments, the linkage 14 may be arranged to allow the hydraulic actuator to move into a generally horizontal position. In some implementations, this may facilitate an even more compact retracted system.

In the illustrated embodiment, the system 10 has a single central actuator assembly 18 configured to operate spaced-apart linkage arms to selectively extend and retract the step assemblies 16*a-b*. In alternative embodiments, the location and/or number of actuators may vary from application to application. Further, the actuator assembly 18 of the illustrated embodiment is a linear actuator that is mounted between the main frame 12 and the linkage 14. In operation, extension and retraction of the linear actuator moves the system between the retracted position and the extended position. In alternative embodiments, the actuator assembly 18 may be a rotary actuator rather than a linear actuator.

Figure 3:
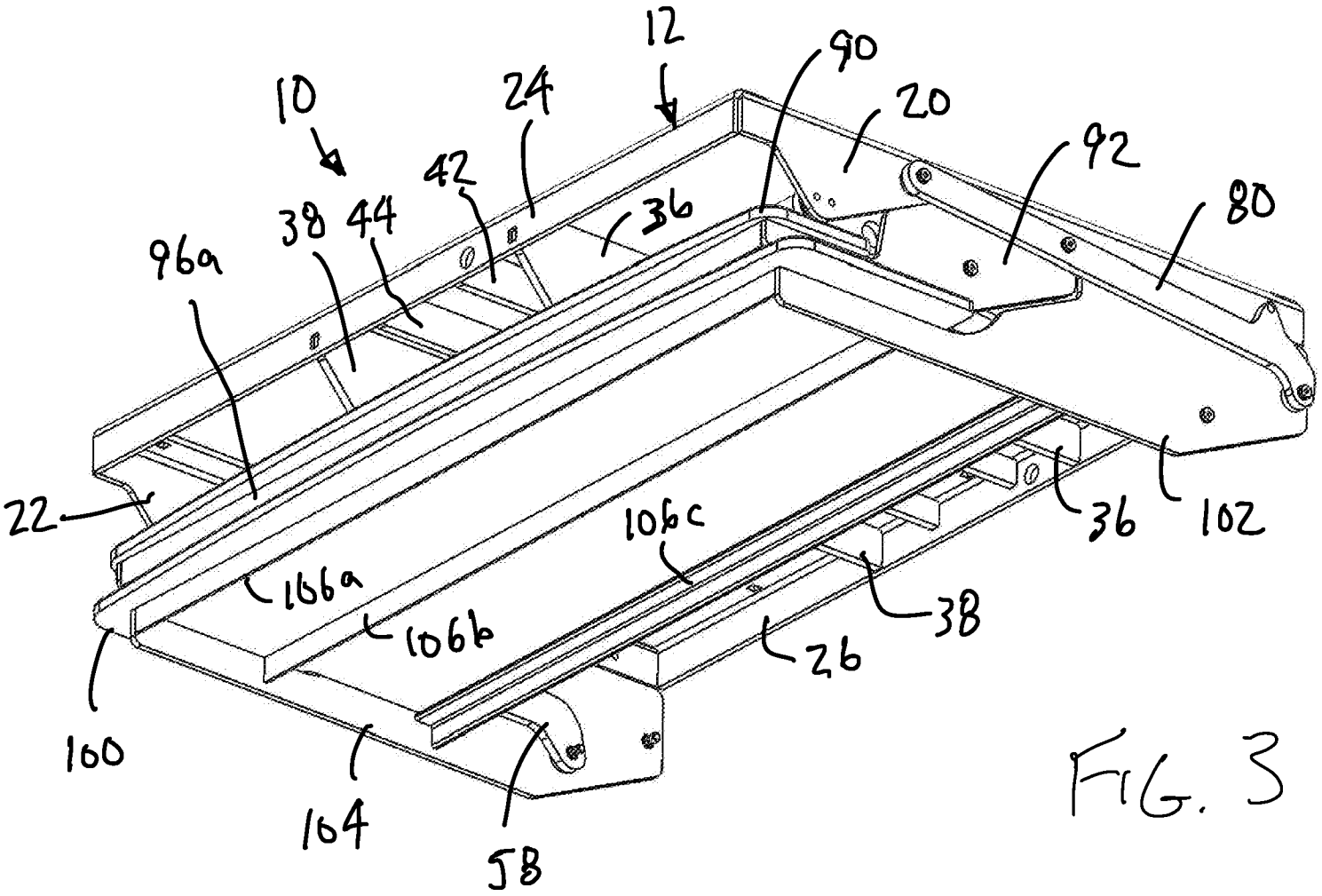
FIG. 3 is a bottom perspective view of the retractable step system in the retracted position.
Figure 4:
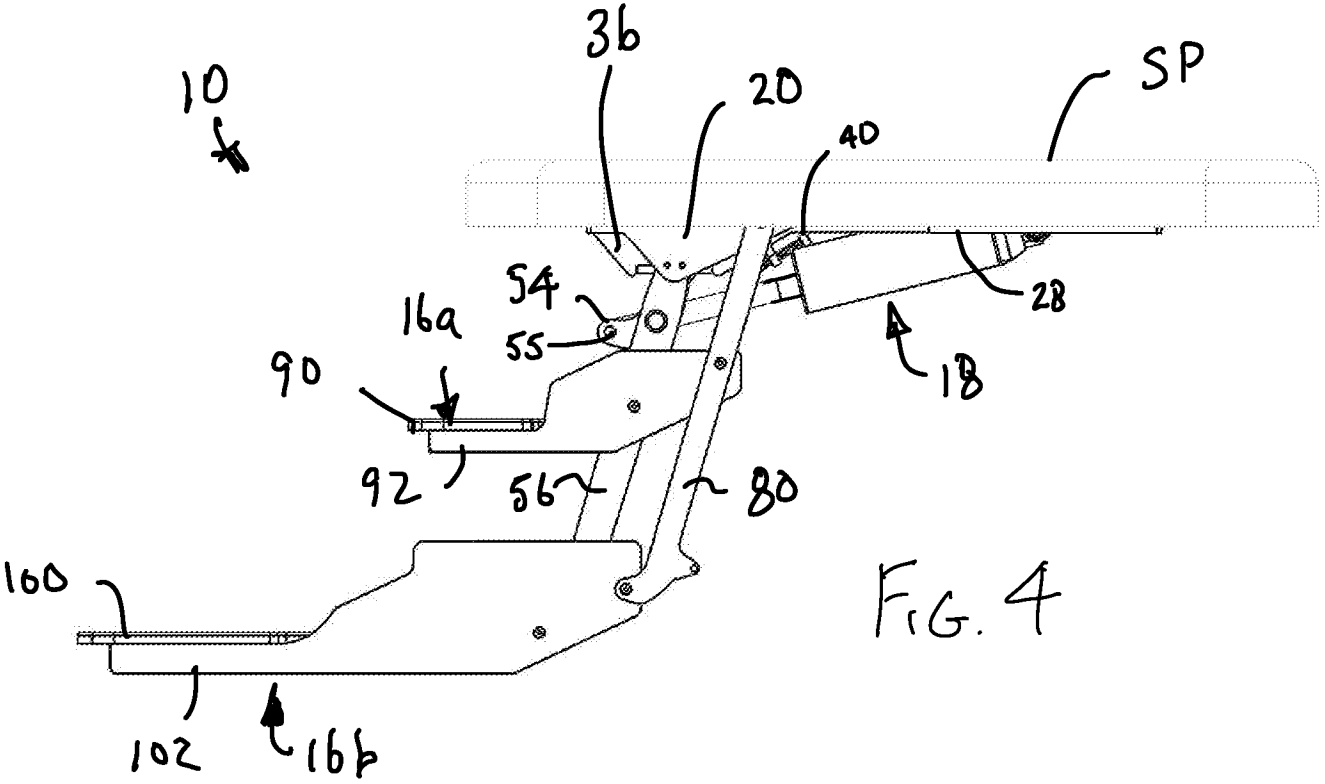
FIG. 4 is a side view of the retractable step system shown mounted below a swim platform with the steps extended.
Figure 5:
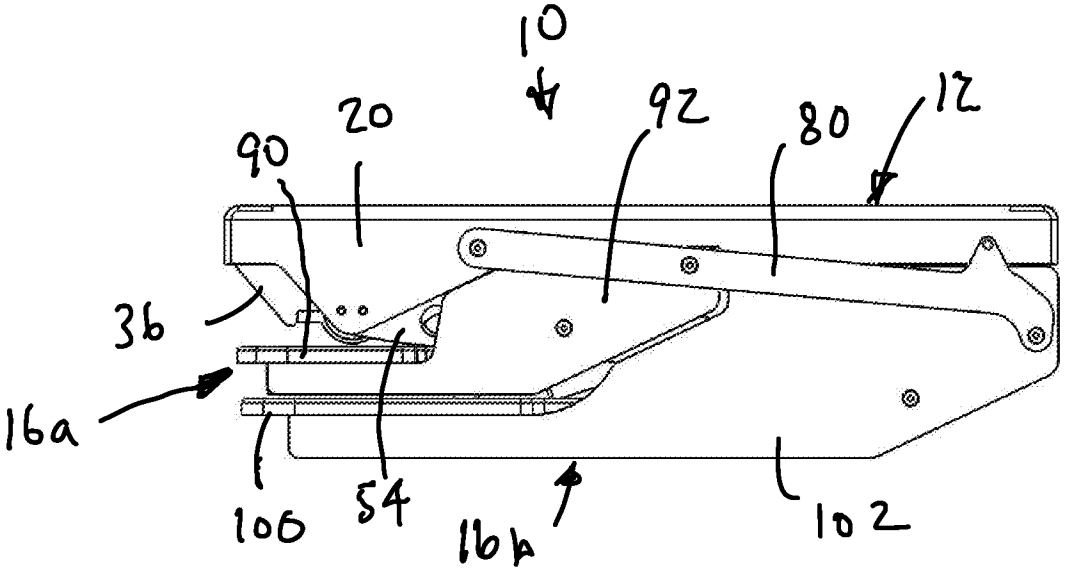
FIG. 5 is a side view of the retractable step system in the retracted position.

Referring now to FIGS. 3 and 5, when in the retracted position, the steps 90, 100 and associated linkage 14 are folded into a compact arrangement under the swim platform (or other mounting structure), where they occupy limited space and are generally hidden from view. In the extended position (See FIGS. 2 and 4), the steps 90, 100 and a portion of the associated linkage 14 are extended beyond the swim platform (or other mounting structure), where they can be used as steps to climb up or down from the swim platform. Further, the extended steps 90, 100 can be used as a place to rest, lounge, sit or otherwise enjoy the water. The system 10 is well suited for use not only by humans, but also by pets, which can have a particularly difficult time entering and exiting a boat.

In the illustrated embodiment, the linkage 14 maintains the steps in a generally horizontal orientation throughout the entire range of motion. This allows use the system 10 when the steps 90, 100 are in a range of positions between the retracted and extended positions. For example, when the water is shallow, the steps 90 may reach the ground before they are fully extended. In those situations, the operator may use the system 10 by partially extending the system 10 to bring the lower step 100 into a position against or close to the ground.

The linkage 14 and step assemblies 16*a-b* are configured to provide a compact system 10 when in the fully retracted position. In the illustrated embodiment, the linkage 14 is configured so that the integral linkage arm 56, 58 and the supplemental linkage arm 80, 82 are disposed on opposite sides of the associated step brackets 92, 94, 102, 104, thereby allowing the integral linkage arms and the supplemental linkage arms to pivot compactly along opposite sides of the step brackets as the system 10 is moved into the retracted position. More specifically, in this embodiment, the integral linkage arms 56, 58 are disposed on the inside of the step brackets 92, 94, 102, 104 and the supplemental linkage arms 80, 82 are located on the outside (See FIGS. 9 and 10).

In this embodiment, the side members 20 and 22 are arranged in a common plane with the corresponding step brackets 92, 94, 102, 104 of the upper step. In one embodiment, the side plate and corresponding step bracket are configured to closely nest when the system is folded into the retracted position (See FIG. 5). As shown, each side member 20 and 22 of this embodiment has a somewhat triangular downward extension that receives and supports a free end of the torque tube 52. Each upper step bracket 92, 94 is shaped with a profile that closely accommodates the downward extension of the corresponding side member 20, 22 when the system 10 is in the retracted position. Further, the step brackets 92, 94 of the upper step assembly 16*a* are arranged in a common plane with the step brackets 102, 104 of the lower step assembly 16*b*, and are configured to closely nest when the system 10 is moved into the retracted position. In this embodiment, each step bracket 92, 94, 102, 104 is generally L-shaped having a main portion that is coupled to the linkage arms and a reduced-height step portion that underlies and supports at least a portion of the associated step. As shown, the main portions of upper step brackets 92, 94 may fit closely into the space above the reduce-height step portion of corresponding lower step brackets 102, 104. This nesting configuration provides a compact profile while maintaining step brackets of sufficient structural integrity.

Directional terms, such as "aft," "fore," "forward," "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The invention claimed is:

1. A retractable step system for a boat, comprising:

a main frame having a first side member and a second side member;

a linkage movably coupled to the main frame, the linkage including a bell crank assembly having a torque tube, a first bell crank linkage arm disposed toward one end of the torque tube and second bell crank linkage arm disposed toward an opposite end of the torque tube and a bell crank extending from the torque tube, the torque tube rotatably mounted between the first side member and the second side member, the linkage including a first supplemental linkage arm mounted to the first side member and a second supplemental linkage arm mounted to the second side member;

a plurality of step assemblies coupled to the linkage, each step assembly including a first step bracket operatively coupled to the first bell crank linkage arm and the first supplemental linkage arm and a second step bracket operatively coupled to the second bell crank linkage arm and the second supplemental linkage arm, each step assembly further including a step extending between and supported by the first step bracket and the second step bracket; and a single actuator connected between the main frame and the bell crank, whereby operation of the actuator rotates the bell crank assembly relative to the main frame and moves the linkage between a retracted position in which the steps and the linkage are disposed beneath the main frame and an extended position in which the steps and at least a portion of the linkage is disposed outwardly from beneath the main frame.

2. The retractable step system of claim 1 wherein the actuator assembly includes a self-contained hydraulic actuator.

3. The retractable step system of claim 2 wherein the bell crank linkage arms and the supplemental linkage arms are operatively coupled to the step brackets so that the steps remain in a generally horizontal orientation throughout the entire range of motion between the extended position and the retracted position.

4. The retractable step system of claim 3 wherein the steps include an upper step and a lower step, the lower step having a depth at least two times the depth of the upper step.

5. The retractable step system of claim 4 wherein the upper step and the lower step each have an outer edge, the outer edge of the lower step being in general vertical alignment with the outer edge of the upper step when the system is in the retracted position.

6. The retractable step system of claim 5 wherein the plurality of step assemblies includes an upper step assembly and a lower step assembly, each of the step brackets of the lower step assembly are generally L-shaped; and wherein the step brackets of the upper step assembly nest within the L-shaped lower step brackets when the system is in the retracted position.

7. The retractable step system of claim 6 where each of the first side member and the second side member includes a downward extension, the downward extensions supporting opposite ends of the torque tube.

8. The retractable step system of claim 7 wherein each of the step brackets of the upper step assembly are generally L-shaped; and wherein the downward extensions nest within the L-shaped upper step brackets when the system is in the retracted position.

9. The retractable step system of claim 8 wherein the main frame includes a subframe, the subframe including a pair of side plates, each side plate defining a torque tube seat; and wherein the torque tube of the bell crank assembly is rotatably disposed in the torque tube seats.

* * * * *